US007389563B2

(12) United States Patent
Martinez et al.

(10) Patent No.: US 7,389,563 B2
(45) Date of Patent: Jun. 24, 2008

(54) CLEANING DEVICE WITH PIVOTING TANK

(75) Inventors: David Martinez, Williamsport, PA (US); Robert L. Crevling, Jr., Williamsport, PA (US)

(73) Assignee: Shop Vac Corporation, Williamsport, PA (US)

( * ) Notice: Subject to any disclaimer, the term of this patent is extended or adjusted under 35 U.S.C. 154(b) by 98 days.

(21) Appl. No.: 11/294,025

(22) Filed: Dec. 5, 2005

(65) Prior Publication Data

US 2007/0124885 A1 Jun. 7, 2007

(51) Int. Cl.
*A47L 9/00* (2006.01)

(52) U.S. Cl. ..... 15/327.1; 15/327.2; 15/353

(58) Field of Classification Search ..... None
See application file for complete search history.

(56) References Cited

U.S. PATENT DOCUMENTS

| | | | | |
|---|---|---|---|---|
| 763,855 | A * | 6/1904 | Charlebois | 248/132 |
| 1,220,640 | A * | 3/1917 | Kelly | 248/129 |
| 2,043,896 | A * | 6/1936 | Larsen et al. | 248/132 |
| 3,930,630 | A * | 1/1976 | Wulff | 248/129 |
| 4,193,161 | A * | 3/1980 | Scott | 15/352 |
| 5,979,014 | A | 11/1999 | Reichow et al. | |
| 6,302,380 | B1 | 10/2001 | Ultimo, Sr. et al. | |
| 6,318,808 | B1 | 11/2001 | Shayne | |
| 6,536,846 | B1 | 3/2003 | Felty | |
| 6,755,479 | B1 | 6/2004 | Meeks | |
| 2005/0200190 | A1 | 9/2005 | Nye | |

OTHER PUBLICATIONS

Clarke Company, "Flood Sucker" Vacuum (WAP SQ17AE).
Goodway, Commercial Title Wet-Dry Vacuum 115V (EV-60-T).
Nilfisk-ALTO, Wet & Dry Vacuum (ATTIX 761-21 XC 230/50 EU).
Nilfisk-ALTO, Wet & Dry Vacuum (ATTIX 751-11 230/1/50 EU).
Nilfisk-ALTO, Wet & Dry Vacuum (ATTIX 751-21 230/1/50 EU).
Nilfisk-ALTO, Wet & Dry Vacuum (MAXXI WD7 230/1/50/ EU).

* cited by examiner

*Primary Examiner*—David A Redding
(74) *Attorney, Agent, or Firm*—Marshall, Gerstein & Borun LLP

(57) ABSTRACT

The disclosed cleaning device has a suction unit that can be used to take in liquid, a tank that can be used to hold the liquid, a mouth that can be used to pour liquid from the tank, and wheels that form a base. It also has a pivot that can be used to rotate the tank between a normal use position and a pouring position. The pivot is arranged so that in the pouring position, the center of gravity of the unit remains within the horizontal range of the base, even as the mouth of the tank falls outside the horizontal range of the base. As shown, the pivot is 12 inches above the floor and within the horizontal range of the base. In this position, it remains laterally between the center of gravity of the tank and the edge of the base when the tank is emptied.

9 Claims, 2 Drawing Sheets

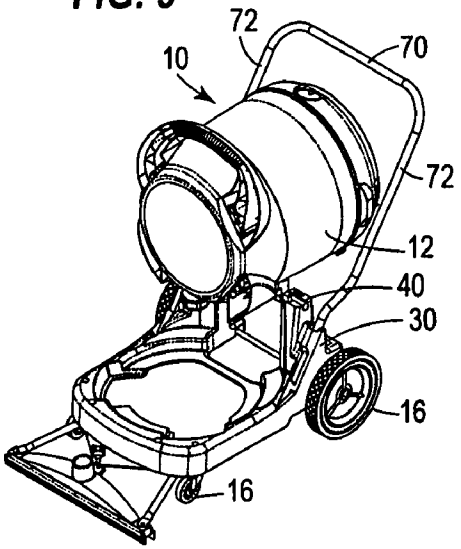
FIG. 7
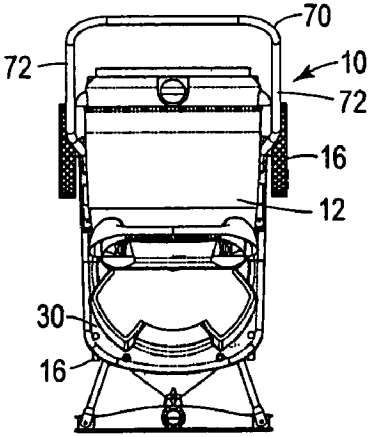
FIG. 8
FIG. 9
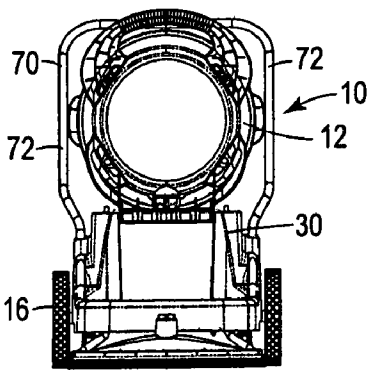
FIG. 10
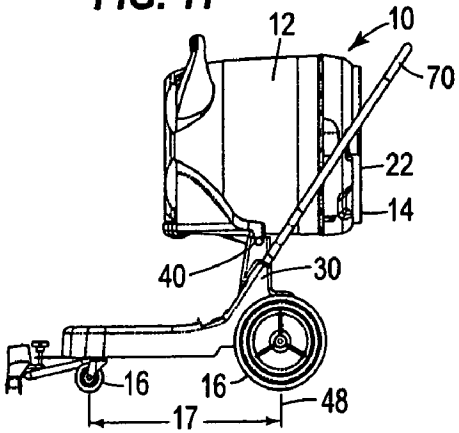
FIG. 11
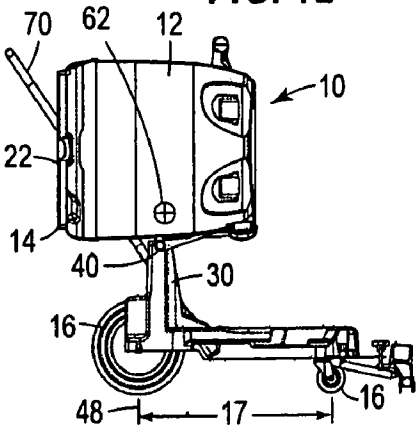
FIG. 12

CLEANING DEVICE WITH PIVOTING TANK

CROSS-REFERENCE TO RELATED APPLICATIONS

Not applicable.

BACKGROUND OF THE INVENTION

The present invention relates generally to cleaning devices, and more particularly to cleaning devices that can take in liquid; devices such as wet/dry vacuums. Wet/dry vacuums include a tank that can be used to hold the liquid, and often have a mouth that can be used to pour liquid from the tank.

When filled with liquid, the tank in a wet/dry vacuum can be heavy. For large units, such as those for heavy-duty use in commercial or industrial settings, the weight can make it difficult to unload the tank.

Heavy-duty wet-dry vacuums are sometimes mounted on carts. For ease of emptying, tilt bars are sometimes provided on the cart. The tilt bar provides a support that can be used to help tilt the tank for emptying.

The use of a tilt bar can be awkward. Generally, when emptying a tank, it is desirable to position the mouth of the tank outside the base of the unit so that the liquid pours into another receptacle, rather than onto the base of unit itself. When using conventional tilt bars, the tank can sometimes flip over the tilt bar, or the cart itself can tip over. Both are usually undesirable.

BRIEF SUMMARY OF THE INVENTION

The applicants have developed an improved cleaning device that may be more stable during emptying of the tank. Like prior known devices, the cleaning device has a suction unit that can be used to take in liquid, a tank that can be used to hold the liquid, a mouth that can be used to pour liquid from the tank, and wheels that form a base. It also has a pivot that can be used to rotate the tank between a normal use position and a pouring position.

In the new arrangement, the pivot is arranged so that even in the pouring position, the center of gravity of the unit remains within the horizontal range of the base. The mouth of the tank may fall outside the horizontal range of the base.

Optionally, the pivot may be located within the horizontal range of the base, in a position where it remains laterally between the center of gravity of the tank and the edge of the base when the tank is emptied. In one embodiment of this arrangement, the pivot is positioned at least 12 inches above the floor.

It is also optional to arrange the unit so that the tank is tipped toward an opening formed between opposed arms of the handle. A removable storage basket may sometimes be fitted within that opening when the tank is in the normal, use position.

BRIEF DESCRIPTION OF THE DRAWINGS

The invention may be better understood by referring to the accompanying drawings, in which:

FIGS. 7-12 are views, corresponding to the views of FIGS. 1-6, of the same device in a pouring position. In this position, the power head of the device has been removed.

DETAILED DESCRIPTION

Figure 3:
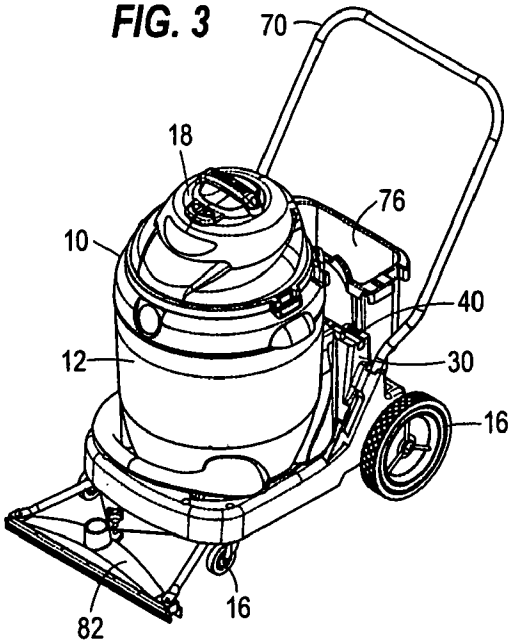
FIG. 3 is a perspective view of the device seen in FIGS. 1 and 2.
Figure 2:
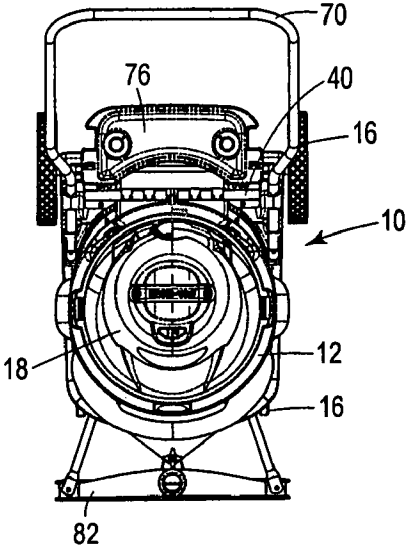
FIGS. 1 and 2 are bottom and top plan views of one embodiment of a cleaning device that incorporates the invention.
Figure 1:
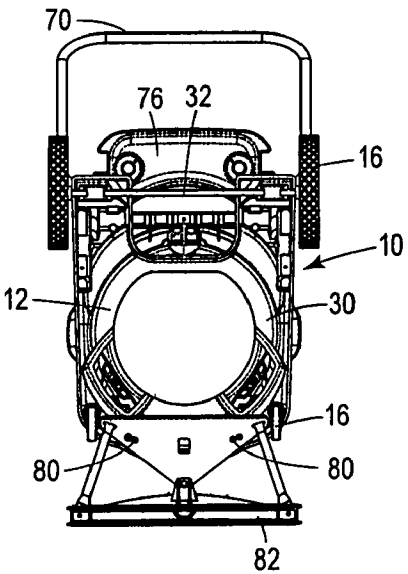
Figure 5:
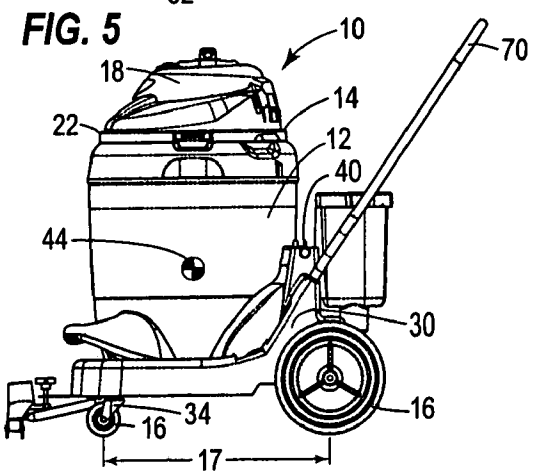
FIGS. 4 and 5 are elevational side and front views of the device.
Figure 4:
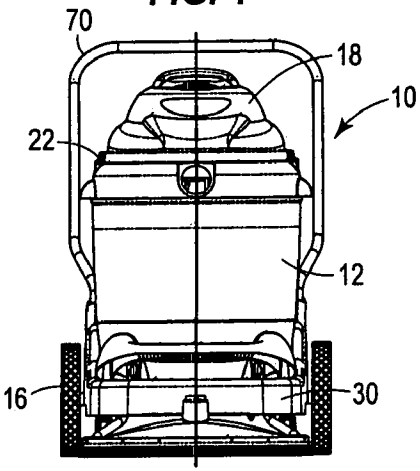

The cleaning device 10 seen in the figures can be used to take in liquid. The device includes a tank 12 that can be used to hold the liquid, a mouth 14 (FIGS. 1, 11, 12) that can be used to pour liquid from the tank, and wheels 16 that form a base 17 (FIG. 5). A conventional suction unit is located within a power head 18 (FIGS. 1-6) that sits atop the tank in the normal use position, and can be removed for pouring liquid from the tank.

The illustrated tank 12 is a nominal 22-gallon plastic tank that is about 21 inches high and about 21 inches wide. When the tank is filled to its wet capacity and the power head 18 is removed, the liquid level is approximately 5 inches below the upper rim 22 (FIGS. 4-6) of the tank. The illustrated mouth 14 (FIGS. 11, 12) is part of the upper rim of the tank, and is positioned approximately 10 inches from the centerline of the tank. Metal tanks and tanks and mouths of other sizes, and shapes, and arrangements can also be used.

Figure 6:
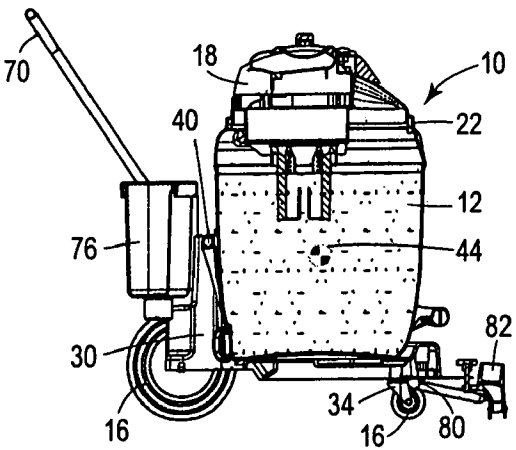
FIG. 6 is a cross-sectional side view of the device.

The wheels 16 are part of a dolly 30. The illustrated wheels include a pair of 10-inch diameter rear wheels that are about 20 inches apart on a rear axle 32 (FIG. 1), and a pair of 3-inch diameter front wheels on front casters 34 (FIG. 6). The casters have stems that are about 16¾ inches apart and about 19½ inches from the rear axle. The wheels define the base 17, and wheels of sizes and arrangements other than those illustrated can be used, and may be advantageous depending upon the size and configuration of the other elements of the device. In this example, the horizontal range of the base extends from the rear axle to the limits of the front wheels. A large base is preferred for stability.

The illustrated device 10 includes a pivot 40 that enables the tank 12 to rotate between a normal use position and a pouring position. In the use position (seen in FIGS. 1-6), both the mouth 14 and the in-use position center of gravity 44 of the device are between the real axle 32 and the front casters 34 on the dolly 30 and are thus within the horizontal range of the base 17. When the tank is rotated to the pouring position (seen in FIGS. 7-13), the mouth moves to a location outside the horizontal range of the base. Although not always necessary, this movement of the mouth usually makes it easier to empty the tank into another receptacle. The illustrated device is designed so that the tank can be emptied by tilting it toward the rear axle 32 of the dolly. In this arrangement, the rear axle may be designated as the "pouring-side edge" 48 of the base (FIG. 12). Other arrangements can also be used.

The illustrated pivot 40 is a hinge with a horizontal axis. One side of the hinge is fixed on a section of the dolly 30, and the other side of the hinge is fixed to the tank 12 or to an adapter on the tank. In the illustrations, the pivot is located within the horizontal range of the base 17, approximately 2 or 3 inches inwards from the pouring-side edge 48 of the base, approximately 15 inches above the floor (and about 12 inches above the bottom of the tank), and approximately 11 inches below the mouth 14. Although these dimensions can be varied, the illustrated distance between the pivot and the floor (given the illustrated 2- or 3-inch distance between the axis of the pivot and the inside surface of the tank) may be advantageous for pouring the tank into a standard-height toilet.

In some previously-known devices, tilt bars are positioned outside the horizontal range of the base. While these arrangements may be stable in the normal use position, tilting the tank during emptying operations generally causes the center of gravity of the unit and any contained liquid to move. If the center of gravity of the unit and any contained liquid moves rearwardly of the pouring-side edge, the unit can become unstable and tip over. Similarly, if the center of gravity of the tank itself and any contained liquid move rearwardly of the tilt bar, the tank can tip over the tilt bar.

Incoming liquid will also move the in-use center of gravity 44 of the device 10. However, arranging the device so that none of the internal volume of the tank 12 is located outside the pivot 40 or outside horizontal extent of the base 17 assures that—so long as the unit is kept level—the in-use position center of gravity will not move outside the base, no matter how much liquid is added.

More importantly, the new arrangement tends to keep the shifting center of gravity 62 (FIG. 12) of the device 10 and any contained liquid within the horizontal range of the base 17 even when the tank 12 is being emptied. Although tipping the tank rearwardly may cause the shifting center of gravity of the device and any contained liquid to move up and back, the pivot 40 is sufficiently high and inward from the pouring-side edge 48 to tend to keep the shifting center of gravity of the device and any contained liquid within the horizontal extent of the base, even as the mouth 14 moves outside the base and liquid begins to pour out of the tank. As a result, the illustrated arrangement minimizes the possibility of the unit tipping over when the tank is emptied.

Similarly, the illustrated arrangement keeps the center of gravity of the tank 12 itself and any contained liquid forward of the pivot 40, minimizing the risk of the tank from tipping over the pivot during emptying. This is not always necessary, however, and other arrangements can also be used.

The illustrated device 10 also has a rearwardly-extending handle 70 that has opposed arms 72 (FIG. 9). The opposed arms form an opening that the tank 12 moves into when being emptied. A removable storage basket 76 (FIGS. 1-3) can be mounted within that opening when the tank is in the normal use position.

Optional mounts 80 (FIGS. 1, 6) on the front of the dolly 30 permit attachments to be added. An optional floor nozzle 82 is illustrated. Other attachments can also be used.

This description of various embodiments of the invention has been provided for illustrative purposes. Revisions or modifications may be apparent to those of ordinary skill in the art without departing from the invention. The full scope of the invention is set forth in the following claims.

The invention claimed is:

1. A vacuum cleaner that has:

a wheelbase;

a tank that has an outer, circumferential wall and holds liquid;

a suction unit that connects to the tank and takes in liquid;

a mouth on the tank that can be used to pour liquid from the tank;

a hinge that is connected to an elevated portion of the outer wall and has an axis that is tangent to the outer wall; and a pivot that is positioned within the wheelbase, connects the hinge to a raised portion of the base, and enables the tank to rotate between a use position and a pouring position while maintaining the center of gravity of the device and any contained liquid within the wheelbase.

2. A vacuum cleaner as recited in claim 1, in which the mouth moves to a location outside the wheelbase when the tank is rotated to the pouring position.

3. A cleaning device as recited in claim 1, in which:

the pivot is located between a use-position center of gravity of the cleaning device and a pouring-side edge of the base; and the device is arranged so that as liquid is poured from the tank, the pivot remains between a center of gravity of the tank itself and the pouring-side edge of the base.

4. A cleaning device as recited in claim 1, in which, in the use position, the pivot is located at least 12 inches above the floor.

5. A cleaning device as recited in claim 1, in which, in the use position, the pivot is located between a center of gravity of the tank itself and a pouring-side edge of the base.

6. A cleaning device as recited in claim 1, in which, in the use position, the pivot is located between a center of gravity of the tank itself and a pouring-side edge of the base, and at least 12 inches above the floor.

7. A cleaning device as recited in claim 1, in which the device also has a handle with opposed arms that form an opening that the tank moves into when being moved to the pouring position.

8. A cleaning device as recited in claim 1, in which the device also has a handle with opposed arms that form an opening that the tank moves into when being moved to the pouring position, and a removable storage basket that fits within that opening when the tank is in the use position.

9. An improved cleaning device with a suction unit that can be used to take in liquid, a tank that can be used to hold the liquid, a mouth that can be used to pour liquid from the tank, a wheelbase, and a pivot that is attached to and has an axis that is tangent to an outer wall of the tank, enables the tank to rotate between a use position and a pouring position, and moves the mouth to a location outside the wheelbase, the improvement being:

that the pivot is positioned inside the wheelbase.

* * * * *